United States Patent [19]

Dickie

[11] 3,940,144

[45] Feb. 24, 1976

[54] GOLFER'S AID

[76] Inventor: Harold G. Dickie, 3830 Kingsway Drive, Highland, Mich. 48031

[22] Filed: Nov. 27, 1972

[21] Appl. No.: 309,703

[52] U.S. Cl. ..... 273/183 B; 273/187 R; 273/188 R; 24/73 A; 24/73 HH; 24/3 M; 272/80; 224/5 R

[51] Int. Cl.[2] ..... A63B 69/36

[58] Field of Search ..... 272/79, 80, 57 B, 70; 273/183, 188, 187; 119/109; 128/25 R, 364, 133, 134, 135; 24/73 A, 73 HH, 3 M; 224/5 R–5 Z

[56] References Cited

UNITED STATES PATENTS

| | | | |
|---|---|---|---|
| 496,696 | 5/1893 | Nash | 24/73 A |
| 936,006 | 10/1909 | Matzner | 182/4 |
| 1,120,496 | 12/1914 | Holsclaw | 182/9 |
| 1,593,166 | 7/1926 | Flach | 224/5 A |
| 1,623,671 | 4/1927 | Frankenfeld | 272/80 |
| 2,860,424 | 11/1958 | McKinnon | 272/70 |
| 2,861,547 | 11/1958 | Dale | 119/109 |
| 2,893,736 | 7/1959 | Tesi | 273/188 R |
| 2,994,300 | 8/1961 | Grahling | 119/109 X |
| 3,204,955 | 9/1965 | Quire et al. | 272/79 R |
| 3,249,356 | 5/1966 | Schweitzer | 272/75 |
| 3,369,809 | 2/1968 | Morrill | 272/79 R |
| 3,677,551 | 7/1972 | Schaus | 273/188 R |

*Primary Examiner*—George J. Marlo
*Attorney, Agent, or Firm*—Lon H. Romanski

[57] ABSTRACT

A device for at all times properly spacing the golfer's feet and at the same time causing the golfer to maintain his knees flexed and allowing him to shift his weight during the backstroke and down swing, the device being constructed so as to be convenient for use while actually playing golf, as opposed to devices intended merely for training, and comprising a belt (or elements such as clips removably attachable to the golfer's belt at each hip) and an elongated flexible, substantially non-stretching member extending between the belt hip positions, the member being of a length such that it is taut when the golfer stands thereon with his feet properly spaced and knees flexed, the member extending from one hip, under the spaced feet and up to the other hip, a more complete form of the device having members for adjustment of the length of the member to accommodate golfers of varying physical configuration and to accommodate proper foot spacing relative to the particular golf club (woods to short irons) being used by any particular golfer.

10 Claims, 4 Drawing Figures

GOLFER'S AID

BACKGROUND OF THE INVENTION

As a participant sport, golf has experienced a tremendous growth in recent years, as evidenced by the great increase in the number of golf courses and the crowded conditions as soon as a new course is ready for play.

Numerous instruction books are now available on the subject of golfing, and a variety of devices are available or have been proposed as training aids for the amateur golfer that seeks to improve his game. Many of these training aids are of the type that, in various ways, attach to some portion of the golfer's anatomy for the purpose of constraining the golfer's movements in such a way that he develops proper form in his stance and/or swing and eliminates bad habits, such as swaying, looking up, back-swinging too far, failing to flex his knees and shift weight, etc.

Whether a particular golfer needs professional lessons, reference to books or use of training aids depends to a large extent upon his own ability to apply what he has learned and his state of development.

While many of the available or proposed training aids may accomplish their intended purposes, there still appears to be a need for a very simple, convenient, safe, inexpensive and light-weight device that is not limited to use in off-the-course practice but is adapted for convenient use during on-the-course golfing so that the golfer can experiment and observe the results of use of the device.

Further, there is a need for such a device that aids in training the golfer to properly space his feet, to flex his knees and to shift his weight properly on the back and down swings.

Additionally, there is a need for such a device that may be easily adjusted to not only accommodate the physical configuration of any particular golfer (height, length of legs, most comfortable and stable stance, etc.), but to also quickly and easily accommodate the proper foot spacing in relationship to the particular golf club (woods to high-numbered irons) being employed by a particular golfer at the time the device is being used.

SUMMARY OF THE INVENTION

Accordingly, an object of the invention is to provide a simple, convenient, safe, inexpensive and light-weight golfer's aid device.

Another object of the invention is to provide such a device that may be employed for both off-the-course practice and on-the-course actual play.

Still another object of the invention is to provide such a device that is adapted to aid the golfer in assuming a proper stance (spread of feet) when addressing the golf ball, flexing his knees so as to avoid a stiff-legged stance and swing and shifting his weight on the back and down swings.

Another object of the invention is to provide such a device that is adjustable, not only to accommodate the physical configuration of various golfers but to also quickly and easily accommodate the proper stance in relationship to the particular golfer.

A still further object of the invention is to provide such a device that assures a more nearly proper stance when adjusted to provide more nearly proper flexing of the knees, and vice versa.

A more specific object of the invention is to provide such a device that comprises, in its simplest form, an adjustable waist belt and a flexible substantially non-stretchable cord or other elongated member having its ends attached (or attachable to the golfer's belt if he is wearing one) to the belt at the golfer's hips, the member being of a length such that it is taut when the golfer stands on the intermediate portion thereof with his knees properly flexed and his feet spread to the extent the member will permit.

Another object of the invention is to provide such a device wherein the elongated member has means for removably attaching the ends thereof to any belt.

Still another object of the invention is to provide such a device having means for adjusting the elongated member to accommodate the golfer and/or the particular golf club he is using.

These and other objects and advantages of the invention will become more apparent by reference to the following detailed disclosure and the appended drawings.

DESCRIPTION OF THE PREFERRED EMBODIMENTS

Figure 1:
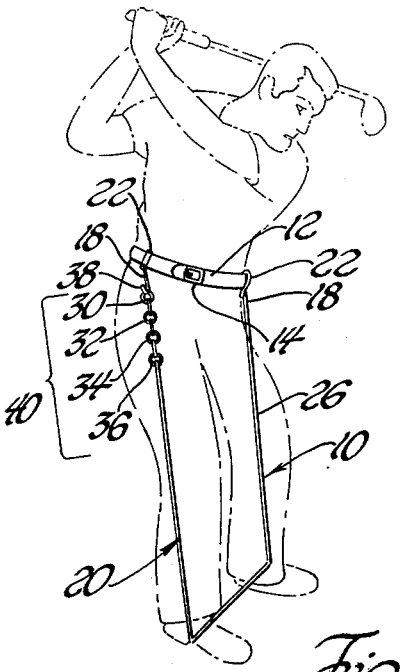
FIG. 1 is a perspective view illustrating the principle of a golfer's aid device embodying the invention, taken generally from the right side of a golfer in a backswing position.
Figure 2:
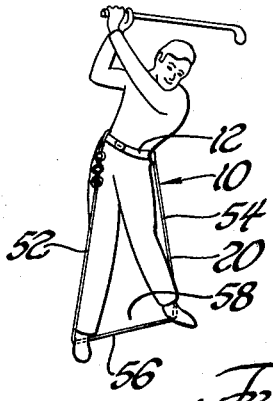
FIG. 2 is a reduced perspective view taken generally from the front of a golfer in the backswing position, illustrating the device of FIG. 1 in actual use.
Figure 3:
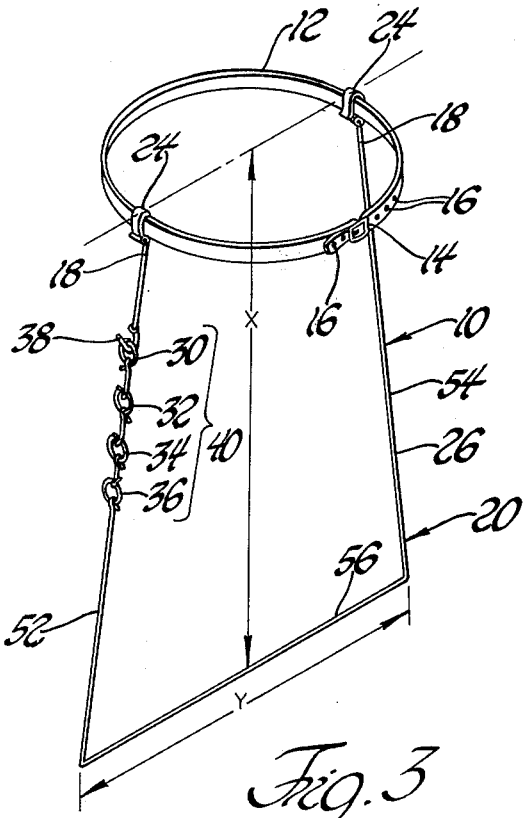
FIG. 3 is an enlarged perspective view of the device shown in FIG. 1.

Referring now to the drawings, and particularly to FIGS. 1–3, a simple embodiment of the golfer's aid device 10 includes, as an element thereof, a belt 12, which may be of any desired material such as leather, fabric and the like, the belt shown having the usual buckle 14 and adjustment holes 16. Obviously, any other known type of waist belt and adjustment arrangement will serve the purpose of the invention.

The primary function of the belt 12 is to anchor the free ends 18 of the elongated, flexible, substantially non-stretching member 20, which may be formed from "Nylon" or other cord of a suitable diameter, such as quarter inch. The ends 18 may be permanently attached to the belt, as by simply passing the same through holes in the belt and tying a knot (not shown) or by means of metal or other rings 22 or spring clips 24 that may be adjusted on the belt for a purpose to be described.

The clips 24 may be employed, for example, in an embodiment of the device 10 adopted for use by a golfer that regularly wears a belt. That is, a golfer normally wearing a belt 12 can merely hook the clips 24 over his own belt. For golfers that do not normally wear a belt, the device 10 would include a belt 12.

The cord member 20 could possibly be continuous from belt to belt, without any breaks therein, as might be the case in a device that is tailor-made for a particular golfer that doesn't desire cord adjustment.

In FIGS. 1–3, the cord 20 comprises a longer segment 26 and a shorter segment 18, the longer segment being shown as provided with spaced metal or other rings 30, 32, 34 and 36 and the shorter segment having a hook 38. It is apparent that the hook 38 may be engaged with any of the rings 30–36, providing a first means 40 to adjust the effective length of the cord 20 for a purpose to be explained.

Figure 4:
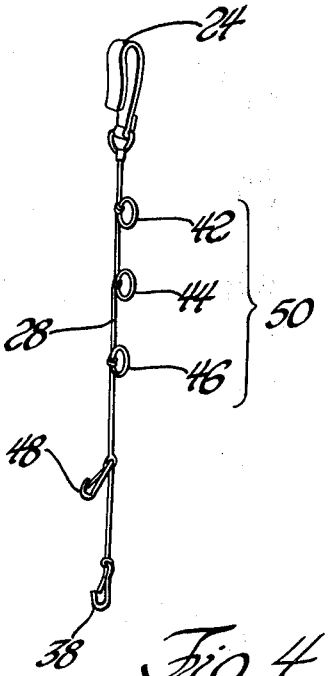
FIG. 4 is an enlarged perspective view illustrating a modification of the invention.

In FIG. 4, which illustrates a modification, the shorter cord segment 28 is itself provided with a series of spaced rings 42, 44 and 46 and an additional hook 48 comprising a second means 50 for adjusting the effective length of the cord 20 for another purpose.

Use of the device 10 is best explained by considering a device such as that shown in FIG. 3, but also having the adjustable shorter segment, with rings 42–46, shown in FIG. 4. That is, the device includes both cord adjustments 40 and 50, which provide a universal design.

First, the golfer fastens the belt securely around his waist, as shown in FIGS. 1 and 2. Next, he attaches the clips 24 so that they are positioned at or adjacent his right and left hips, inserts hook 38 into ring 30, which provides the longest cord length, and steps on the bight of the cord, as shown in FIG. 2.

With his feet on the cord, he consciously spreads his feet to a proper stance with the knees properly flexed. That is, he assumes consciously a position that he knows is correct for addressing the ball when using the No. 1 wood, which requires the widest stance, and thus the longest length of cord 20, for any particular golfer. It is for this reason that adjustment 40, which may be termed the "club" adjustment, was initially set at ring 30.

Having assumed the proper No. 1 wood position, the golfer now moves the hook or snap 48 upwardly and hooks it into the ring 42, 44 or 46 that results in the cord 20 being taut to form substantially equal length first and second upright cord portions 52 and 54 extending from hip to foot and the horizontal portion 56 along the ground between the feet, as shown in FIG. 2. With the above initial conscious adjustment of means 50, which may be termed the "golfer" adjustment, the device is now ready for use.

It will be understood that while the "golfer" adjustment 50 is shown as having one hook 48 and three rings 42–46 (3 positions), any suitable means other than a hook and rings could be employed and sufficient positions could be provided to accommodate the largest and smallest golfer. The same is generally true of the "club" adjustment 40; that is, any suitable means and any number of positions could be provided, the first position 30 being the No. 1 wood position and the last position, such as 36, being the No. 9 iron position, which requires the narrowest stance and thus the shortest cord.

While the adjusted device, as just described, can obviously be used in practice, it is well known that the best practice is actual play on the course, and the device is well suited for that purpose.

For example, let it be assumed that the golfer is out on the course and that he made the above initial adjustment and made a shot off the tee with the No. 1 wood. He can merely step off the cord, gather it up and insert it into his pocket.

If he selects a No. 9 iron for the next shot, he merely pulls out the cord and lowers the bight portion 56 to his feet, sets the adjustment 40 at the last or No. 9 iron position 36, steps into the cord system, spreads his feet as far as the now shorter cord 20 will permit, with the knees properly flexed, and makes the shot.

Referring again to FIG. 3, the dimension X for any particular golfer, which is the distance from the belt to the ground, with the knees properly flexed, is substantially constant for all clubs. Consequently, the length of cord portions 52 and 54 are constant. Further, once the adjustment 50 is made for the particular golfer, the length of the cord 20 is a constant except when a club adjustment 40 is made. Thus, the invention involves a mathematical or geometric basis for varying the dimension Y, which is the stance or spread of the feet, when club adjustments 40 are made, the dimension Y being substantially constant for all shots at any given adjustment 40.

In other words, since the whole is equal to the sum of its parts, and since the belt-to-belt length of cord 20 is constant for any given setting at 50, with any given setting at 40, a constant dimension X will result in a constant dimension Y, and vice versa. That is, if the golfer assumes a proper stance, at given adjustments 40 and 50, his knees will be properly flexed and vice versa. This is because the knees were flexed when the adjustment 50 was made to make cord 20 taut.

Further, since the stance (dimension Y) during a shot does not significantly change, the sum of the lengths of portions 52 and 54 cannot change, although their individual lengths can change, so as to become unequal as seen in FIG. 2, due to the fact that cord 20, being free of any obstructions at its intermediate portion 56, can move (see arrow 58 in FIG. 2) under the feet, which permits the legs to alternately straighten for proper and unrestricted weight shifting and proper hip movement on the back and down swings.

As previously explained, the device 10 of FIG. 1 has adjustment means 40, but no means 50, as would be adequate in a device used only by a particular golfer, the length of cord being selected to fit his particular configuration.

It will be appreciated that particularly with the assistance of a golf professional, a universal device 10, having both adjustment means 40 and 50, can be designed with an adequate number of properly spaced adjustment positions at means 40 and 50 to accommodate all proper club stances for all golfer configurations.

If so desired, the cord 20 may, at any convenient location thereon, or at its connection to the belt, be provided with means, such a male-female or other connector, adapted to separate and thus provide a visual indication that the knees were not maintained flexed or that some other error, such as shifting the feet, was being committed during the shot.

It is apparent from the above description that the invention provides a golfer's aid device that meets the above-mentioned objectives.

While club adjustment and club and golfer configuration adjustment embodiments of the deivce, with modifications, have been shown and described in such clear and concise terms as to enable those skilled in the art to practice the same, other modifications are possible within the scope of the invention, and no limitations are intended, except as recited in the claims.

What I claim as my invention is:

1. A golfer's aid device, comprising flexible substantially non-stretchable first and second elongated members physically detached from each other, said first and second elongated members being of unequal lengths as to have said first elongated member substantially shorter than said second elongated member, said first elongated member having first and second ends, said second elongated member having third and fourth ends, means for anchoring said first and third ends respectively adjacent one hip of the golfer, said second and fourth ends being provided with disconnectable connecting means effective for at times detachably connecting said second and fourth ends to each other, said connecting means being separate from but fixedly carried by said first and second elongated members, said second member being of a length such as to provide first and second generally upright portions interconnected by a lower disposed intermediate bight portion disposed adjacent the golfer's feet when said first and third ends of said first and second members are anchored and said second and fourth ends of said first and second elongated members are operatively connected to each other and said elongated members are hanging freely, said first upright portion being effective to combine with said first elongated member when operatively connected to each other by said connecting means to form a length functionally equal to the length of said second upright portion, said second elongated member being adapted when said second and fourth ends are operatively connected to each other to be placed under the golfer's feet to both limit the spread of the golfer's feet and to maintain the said golfer's knees flexed, at least one of said elongated members being provided with adjustment means for adjusting the overall length of said first and second elongated members when operatively connected to each other, said adjustment means being separate from but fixedly carried by said at least one of said elongated members.

2. A golfer's aid device according to claim 1, wherein said anchoring means comprises a belt to be disposed at the golfer's waist.

3. A golfer's aid device according to claim 2, wherein said anchoring means comprises means for detachably attaching said first and third ends to said belt.

4. A golfer's aid device according to claim 3, wherein said attaching means comprises first and second spring clips for respectively removably attaching said first and third ends to said belt in a manner whereby said spring clips are directly engageable with said belt.

5. A golfer's aid device according to claim 1, wherein said adjustment means for adjusting the overall length comprises separate first and second adjusting means, one of said separate first and second adjusting means is effective to be used for an initial adjustment of said overall length as to suit the legs of the particular golfer, and wherein the other of said separate first and second adjusting means is effective to be used for subsequent adjustment of said overall length as whenever a change in said overall length is needed to accommodate the golfer assuming a stance different from the previously assumed due to the selection and use of a different golfing club while still maintaining the said golfer's knees flexed.

6. A golfer's aid device according to claim 5, wherein said one of said separate first and second adjustment means comprises a hook on said first elongated member, wherein said other of said separate first and second adjustment means comprises a plurality of spaced rings separate from but carried by said second elongated member, and wherein said hook is engageable with any one of said plurality of spaced rings.

7. A golfer's aid device such as that recited in claim 1, wherein that portion of said member placed under the feet is free of obstructions so that as the golfer swings it may move under the feet to permit said upright portions to assume unequal lengths as the golfer's weight is shifted on backswing and downswing.

8. A golfer's training device usable by a golfer while actually playing a game of golf for training the golfer to both properly flex his knees and properly space his feet while addressing a golf ball to be struck, said device comprising flexible substantially non-stretchable elongated cordlike means having first and second ends, said first and second ends being adapted for detachable anchoring attachment to points adjacent opposite hips of said golfer, said cord-like means comprising first and second upright portions interconnected by a bight portion which freely lies along the ground when said first and second ends are detachably anchored to said golfer, said cord-like means also being of a length as to force said golfer to flex his knees when said golfer steps onto said bight portion and spreads his feet as to obtain a desired spacing of said feet to accommodate for the particular length of the shaft of the golf club which said golfer may be employing for striking the golf ball, and length adjustment means for both adjusting the overall length of said cord-like means to adapt it to golfers of varying height and to adjust the length of said cord-like means to accommodate for the varying lengths of the shafts of said golf clubs used by said golfer during said game of golf, said adjustment means comprising first and second adjusting means, at least one of said first and second adjusting means comprising first quick-disconnect connecting members formed separately of but fixedly carried by said cord-like means as to be spaced from each other longitudinally along said cord-like means, said connecting members providing a plurality of latching positions for affecting length adjustment of said cord-like means.

9. A golfer's training device usable by a golfer while actually playing a game of golf for training the golfer to both properly flex his knees and properly space his feet while addressing a golf ball to be struck, said device comprising flexible substantially non-stretchable elongated cord-like means having first and second ends, said first and second ends being adapted for detachable anchoring attachment to points adjacent opposite hips of said golfer, said cord-like means comprising first and second upright portions interconnected by a bight portion which freely lies along the ground when said first and second ends are detachably anchored to said golfer, said cord-like means also being of a length as to force said golfer to flex his knees when said golfer steps onto said bight portion and spreads his feet as to obtain a desired spacing of said feet to accommodate for the particular length of the shaft of the golf club which said golfer may be employing for striking the golf ball, and length adjustment means for both adjusting the overall length of said cord-like means to adapt it to golfers of varying height and to adjust the length of said cord-like means to accommodate for the varying lengths of the shafts of said golf clubs used by said golfer during said game of golf, said adjustment means comprising first and second adjusting means, said first adjusting means comprising a first quick-disconnect means being adapted for latching into a plurality of latching positions, said second adjusting means comprising second quick-disconnect means having a plurality of latching positions, said cord-like means comprising first and second cord-like portions physically separated from each other but mechanically detachably connectable to each other by said quick-disconnect means, said first quick-disconnect means comprises latching means formed separately of but totally carried by said first cord-like portion, and said second quick-disconnect means comprises a plurality of spaced second latching means formed separately of but carried by said second cord-like portion.

10. A golfer's training device usable by a golfer while actually playing a game of golf for training the golfer to both properly flex his knees and properly space his his feet while addressing a golf ball to be struck, said device comprising flexible substantially non-stretchable elongated cord-like means having first and second ends, said first and second ends being adapted for detachable anchoring attaching to points adjacent opposite hips of said golfer, said cord-like means comprising first and second upright portions interconnected by a bight portion which freely lies along the ground when said first and second ends are detachably anchored to said golfer, said cord-like means also being of a length as to force said golfer to flex his knees when said golfer steps onto said bight portion and spreads his feet as to obtain a desired spacing of said feet to accommodate for the particular length of the shaft of the golf club which said golfer may be employing for striking the golf ball, and length adjustment means for both adjusting the overall length of said cord-like means to adapt it to golfers of varying height and to adjust the length of said cord-like means to accommodate for the varying lengths of the shafts of said golf clubs used by said golfer during said game of golf, said adjustment means comprising first and second adjustment means, said first adjustment means comprising first quick-disconnect means having a plurality of latching positions, and said second adjustment means comprising second quick-disconnect means also having a plurality of latching positions, said first quick-disconnect means further comprising a first plurality of ring-like latch portions, and said second quick-disconnect means further comprising a second plurality of ring-like latch portions.

* * * * *